US010767133B2

(12) United States Patent
Dura

(10) Patent No.: US 10,767,133 B2
(45) Date of Patent: Sep. 8, 2020

(54) PROTECTED MERCAPTOPHENOLS AND THIOPHENOLS FOR LUBRICATING COMPOSITIONS

(71) Applicant: The Lubrizol Corporation, Wickliffe, OH (US)

(72) Inventor: Robert D. Dura, Broadview Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 39 days.

(21) Appl. No.: 16/062,645

(22) PCT Filed: Dec. 7, 2016

(86) PCT No.: PCT/US2016/065287

§ 371 (c)(1),
(2) Date: Jun. 15, 2018

(87) PCT Pub. No.: WO2017/105951

PCT Pub. Date: Jun. 22, 2017

(65) Prior Publication Data

US 2018/0371351 A1 Dec. 27, 2018

Related U.S. Application Data

(60) Provisional application No. 62/268,753, filed on Dec. 17, 2015.

(51) Int. Cl.

| | |
|---|---|
| ***C10M 135/30*** | (2006.01) |
| ***C10M 159/22*** | (2006.01) |
| ***C10M 101/02*** | (2006.01) |
| ***C10M 107/02*** | (2006.01) |

(52) U.S. Cl.

CPC ..... *C10M 135/30* (2013.01); *C10M 101/02* (2013.01); *C10M 107/02* (2013.01); *C10M 159/22* (2013.01); *C10M 2203/1025* (2013.01); *C10M 2205/06* (2013.01); *C10M 2207/026* (2013.01); *C10M 2207/028* (2013.01); *C10M 2207/262* (2013.01); *C10M 2215/064* (2013.01); *C10M 2215/28* (2013.01); *C10M 2219/044* (2013.01); *C10M 2219/046* (2013.01); *C10M 2219/087* (2013.01); *C10M 2219/088* (2013.01); *C10M 2219/089* (2013.01); *C10M 2223/045* (2013.01); *C10N 2210/01* (2013.01); *C10N 2210/02* (2013.01); *C10N 2210/04* (2013.01); *C10N 2230/02* (2013.01); *C10N 2230/04* (2013.01); *C10N 2230/06* (2013.01); *C10N 2230/08* (2013.01); *C10N 2230/10* (2013.01); *C10N 2230/43* (2013.01); *C10N 2230/45* (2013.01); *C10N 2230/52* (2013.01); *C10N 2240/04* (2013.01); *C10N 2240/042* (2013.01); *C10N 2240/044* (2013.01); *C10N 2240/046* (2013.01); *C10N 2240/10* (2013.01); *C10N 2240/102* (2013.01)

(58) Field of Classification Search

CPC ..... C10M 135/30; C10M 101/02; C10M 107/02; C10M 159/22; C10M 2207/026; C10M 2223/045; C10M 2207/262; C10M 2215/064; C10M 2219/046; C10M 2215/28; C10M 2219/044; C10M 2205/06; C10M 2219/087; C10M 2203/1025; C10M 2207/028; C10M 2219/088; C10M 2219/089; C10N 2210/04; C10N 2240/044; C10N 2240/042; C10N 2230/43; C10N 2240/10; C10N 2230/45; C10N 2240/04; C10N 2230/02; C10N 2230/04; C10N 2230/08; C10N 2240/046; C10N 2210/01; C10N 2210/02; C10N 2230/06; C10N 2230/10; C10N 2230/52; C10N 2240/102; C10N 2220/022

See application file for complete search history.

(56) References Cited

U.S. PATENT DOCUMENTS

| | | | | | |
|---|---|---|---|---|---|
| 3,952,063 | A * | 4/1976 | Hay | C07C 323/00 568/45 |
| 4,064,179 | A | 12/1977 | Hay | |
| 4,602,113 | A * | 7/1986 | McKinnie | C07C 323/00 568/54 |
| 4,772,405 | A * | 9/1988 | Wirth | C07C 323/00 252/404 |
| 5,071,822 | A | 12/1991 | Nakamura et al. | |

FOREIGN PATENT DOCUMENTS

| | | | | |
|---|---|---|---|---|
| GB | 776455 | A * | 6/1957 | C10M 159/24 |
| SU | 1077885 | A1 * | 3/1984 | |
| WO | 2015/183685 | A1 | 12/2015 | |

OTHER PUBLICATIONS

SAE Guide https://www.api.org/~/media/files/certification/engine-oil-diesel/publications/mom_guide_english_2013.pdf (Year: 2013).*
Schroeder Viscosity Classification Equivalents (2008) (Year: 2008).*

* cited by examiner

*Primary Examiner* — Pamela H Weiss
(74) *Attorney, Agent, or Firm* — Michael Miller; Teresan Gilbert

(57) ABSTRACT

A lubricating composition includes an oil of lubricating viscosity and a compound comprising a protected mercaptophenol. The protected mercaptophenol includes a mercapto group in which the hydrogen is substituted with a substituent of at least 5 carbons. The substituent is selected from hydroxy-substituted hydrocarbyl groups, poly(ether) groups, hydrocarbyl groups, and mixtures and salts thereof.

7 Claims, No Drawings

PROTECTED MERCAPTOPHENOLS AND THIOPHENOLS FOR LUBRICATING COMPOSITIONS

CROSS REFERENCE TO RELATED APPLICATION

This application claims priority from PCT Application Serial No. PCT/US2016/065287 filed on Dec. 7, 2016, which claims the benefit of U.S. Provisional Application No. 62/268,753 filed on Dec. 17, 2015, both of which are incorporated in their entirety by reference herein.

BACKGROUND

The exemplary embodiment relates to lubricant additives and in particular to protected mercaptophenols useful in lubricating compositions.

Thermal and mechanical stresses on lubricants, such as engine and driveline oils, tend to increase the tendency towards formation of deposits on the lubricated components, such as internal combustion engines and driveline components. This can negatively impact the performance of the lubricated components through reduction in engine efficiency or overall life-expectancy. Such lubricants generally incorporate, in addition to a base oil, a number of additives, including friction modifiers, antiwear agents, antioxidants, dispersants, and detergents, that are used to protect lubricated components from wear, oxidation, soot deposits, corrosion, acid build up, and the like, and to improve water tolerance and compatibility of formulation components.

Dispersants are used for dispersing impurities such as wear particles, soot and other contaminants. Amine-based dispersants, such as polyamine succinimides, have been widely used. These dispersants often have basic functionality which can help to neutralize acidic contaminants. However, they have a tendency to reduce corrosion protection and seals compatibility.

Salicylate and catecholate additives have been used to provide desirable performance attributes to lubricant formulations, including cleanliness, antioxidancy, and dispersancy.

Branched para-$C_{12}$-alkylphenols, including p-dodecylphenol (PDDP) also known as tetrapropenylphenol (TPP), formed from tetrapropene have seen extensive commercial use as chemical intermediates in the production of oil and lubricant additives for gasoline and diesel-powered engines. Recently, however, some countries have placed limits on the amount PDDP that is considered acceptable. Therefore it is desirable to develop an alternative to PDDP and other alkylphenols for use as detergents.

There have been several efforts to prepare detergents that do not contain alkyl phenols derived from oligomers of propylene. These include U.S. Pub. Nos. 2008/0269351, 2011/0118160, 2011/0124539, 2011/0190185, 2010/0029529 and WO 2013/059173. Other compounds are disclosed in U.S. Pat. Nos. 6,310,009, 6,235,688, 5,510,043, 4,221,673, 4,643,838, 4,729,848, 4,058,472, 3,816,353, 3,864,286, 4,058,472, 3,816,353, 3,864,286, and U.S. Pub. Nos. 2007/0049508, 255/0288194, 2004/077507, 2014/130767, WO 2014/033323, and EP 2374866 A1.

BRIEF DESCRIPTION

In accordance with one aspect of the exemplary embodiment, a lubricating composition includes an oil of lubricating viscosity and a compound comprising a protected mercaptophenol. The protected mercaptophenol includes a mercapto group that is substituted with a substituent of at least 5 carbons, the substituent being selected from hydroxy-substituted hydrocarbyl groups, (poly)ether groups, hydrocarbyl groups, and mixtures and salts thereof.

In accordance with another aspect of the exemplary embodiment, a method of forming a lubricating composition includes reacting a mercaptophenol with an oxirane to form a reaction product and combining the reaction product with an oil of lubricating viscosity.

In accordance with another aspect of the exemplary embodiment, a lubricating composition includes an oil of lubricating viscosity and a compound of a general form selected from:

Formula II

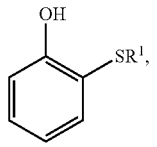

Formula III

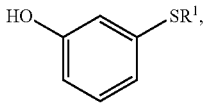

Formula IV

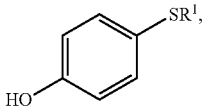

Formula V

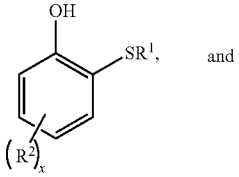

and

Formula VI

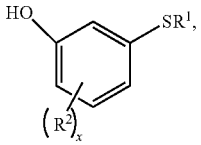

and salts and mixtures thereof, wherein $R^1$ is selected from hydrocarbyl groups and hydroxy-substituted hydrocarbyl groups (e.g., —$CH_2CH(OH)R^3$, where $R^3$ is a non-aromatic hydrocarbyl group of at least 5 carbon atoms), each $R^2$ in Formula V or VI is independently selected from acyl groups (e.g., of the form —(C═O)$R^6$, where $R^6$ is a hydrocarbyl group of 1 to 24 carbon atoms), hydrocarbyl groups, and groups in which two $R^2$ groups together form a ring, and mixtures thereof; and x is at least 1.

DETAILED DESCRIPTION

Aspects of the exemplary embodiment relate to a protected mercaptophenol (e.g., a protected thiocatechol), a lubricating composition containing the compound, a method of lubrication, and a use of the lubricating composition.

The exemplary lubricating composition includes an oil of lubricating viscosity (or "base oil") and a protected mercaptophenol compound that can serve as either a dispersant or detergent in the lubricating composition.

A. The Compound

The exemplary protected mercaptophenol is a mercaptophenol in which the hydrogen of the thiol group is replaced with a substituent that may serve as a sulfur-protecting group. The protected mercaptophenol may be formed by reacting a mercapto group of a mercaptophenol with a compound which forms, for instance, an —$SR^1$ substituent in place of an original —SH group of the mercaptophenol, where $R^1$ is described below. The term "protected" is not intended to imply that the reaction is reversible.

The protected mercaptophenol may be the reaction product of an oxirane or ether with a mercaptophenol, such as an optionally-substituted thiocatechol. The protecting group may include a hydrocarbyl group of at least 5 carbons or at least eight carbons in length. The protected mercaptophenol may be reacted with a cation serving as the counter ion in the compound.

The protected mercaptophenol may be represented by the general structure shown in Formula I:

Formula I

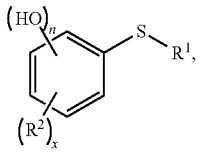

and mixtures and salts thereof, where the substituent $R^1$ is selected from hydroxy-substituted hydrocarbyl groups (e.g., —$CH_2CH(OH)R^3$), hydrocarbyl groups (e.g., $C_5$-$C_{40}$ non-aromatic groups), and (poly)ether groups (e.g., poly(ether) groups of the form —$(CH_2CHR^4—O—)_mR^5$);

$R^3$ is a hydrocarbyl group of at least 5 carbon atoms;

each $R^4$ is independently selected from H, a hydrocarbyl group, and an acyl group (e.g., of the form

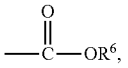

which is represented herein as —(C═O)$R^6$;

$R^5$ is selected from hydrogen and a hydrocarbyl group;

each $R^2$ is independently selected from acyl groups (e.g., —(C═O)$R^6$), hydrocarbyl groups (e.g., of 1-40 carbon atoms), and groups in which two $R^2$ groups together form a ring, which may be an aromatic or a cycloaliphatic ring (in which case x is at least 2), and mixtures thereof;

each $R^6$ is a hydrocarbyl group (e.g., of 1 to 40 carbon atoms);

m is at least 1;

n is at least 1, e.g., from 1 to 3; and x is from 0 to 3.

$R^1$ may include up to 40, or up to 30 carbon atoms, such as at least 6, or at least 8, or at least 10, or at least 12, or at least 14 carbon atoms, or in the case of a mixture of Formula I compounds, a number average of at least 6, or at least 8, or at least 10, or at least 12 carbon atoms.

In one embodiment, $R^1$ is a hydroxy-substituted hydrocarbyl group of the general form —$CH_2CH(OH)R^3$. In this embodiment, $R^3$ may be a non-aromatic hydrocarbyl group of 5 to 40 carbon atoms, such as at least 6, or at least 8, or at least 10, or at least 12 carbon atoms, and in one embodiment, up to 30 or up to 24 carbon atoms. In one embodiment, $R^3$ is a branched or straight chain aliphatic group, such as an alkyl or alkenyl group. Exemplary $C_5$ to $C_{30}$ alkyl groups useful as $R^3$ include pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups, and mixtures thereof.

In another embodiment, $R^1$ is —$(CH_2CH(R^4)—O—)_mR^5$, where m is at least 1. Examples of non-aromatic hydrocarbyl groups suitable for use as $R^4$ and $R^5$ include branched and straight chain aliphatic groups, such as an alkyl or alkenyl group, such as a $C_1$-$C_{30}$ alkyl group, e.g., methyl, ethyl, propyl, butyl, and those suggested for $R^3$. In one embodiment, at least one of $R^4$ and $R^5$ is at least a $C_5$, or at least a $C_8$ alkyl group. In one embodiment, m is up to 20, or up to 10, or up to 5, on average. In various embodiments, m is from 1 to 10, or 1 to 4, or 1 to 2, or 1.

In another embodiment, $R^1$ is a hydrocarbyl group, such as a non-aromatic hydrocarbyl group. In various embodiments, $R^1$ is a hydrocarbyl group of at least 5, or at least 6, or at least 8, or at least 10, or at least 12 carbon atoms, or up to 40, or up to 32, or up to 24, or up to 20, or up to 16 carbon atoms. Exemplary hydrocarbyl groups suitable for $R^1$ include branched and straight chain alkyl and alkenyl groups, such as a $C_6$-$C_{40}$ alkyl group, or at least $C_8$, or at least $C_{10}$, or at least $C_{12}$ alkyl group, such as those suggested for $R^3$.

In one embodiment, $R^2$ is a hydrocarbyl group. $R^2$ may be selected from substituted and unsubstituted alkyl and alkenyl groups of 1 to 150 carbon atoms, such as at least 4 carbon atoms, or 1 to 80, or 4 to 40, or 10 to 20, or 12 to 16 carbon atoms. Exemplary $C_1$-$C_{30}$ alkyl groups suitable for $R^2$ include methyl, propyl, butyl, and those suggested for $R^3$.

In one embodiment, $R^2$ is may be a hydrocarbyl group of 1 to 40 or 1-30 carbon atoms, such as a branched or straight chain $C_1$-$C_{30}$ alkyl group, such as those suggested for $R^3$, or $C_1$-$C_{30}$ alkenyl group which may be mono- or poly-unsaturated. Specific examples of branched alkyl groups include isooctyl and 2-ethylhexyl groups.

In one embodiment, two $R^2$ groups are joined to form a ring and are both hydrocarbylene groups of 2 to 4 carbon atoms, such as ethylene, propylene, butylene, etc. In one embodiment, the ring may include one or more heteroatoms, such as N, O, or S.

In one embodiment, $R^6$ is a hydrocarbyl group (of 1 to 40 carbon atoms, or up to 24 carbon atoms, or up to 12 carbon atoms, and in some embodiment may be selected from those exemplified for $R^2$.

In one embodiment, x is 0 to 2. In another embodiment, x is 0.

In one embodiment, n is 1. In another embodiment, n is 2.

In exemplary embodiments, when n is 1, —$SR^1$ is ortho, meta, or para to OH.

In an exemplary embodiment, the sulfur group in the compound of Formula I does not form a bridge between two aromatic groups.

As will be appreciated, these aspects can also be used in combinations thereof. In the case of the salt, the exemplary compound of Formula I may serve as an anion and be associated with a cation serving as a counter ion in the compound.

In specific embodiments disclosed herein, the compound of Formula I is selected from the general structures shown in Formulas II-VI:

Formula II

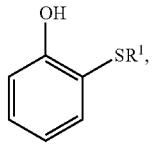

Formula III

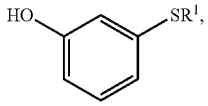

Formula IV

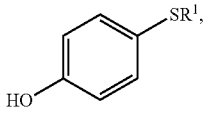

Formula V

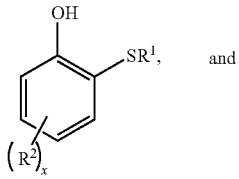

and

Formula VI

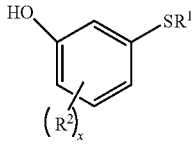

and salts and mixtures thereof, wherein $R^1$ is selected from a hydrocarbyl group and —$CH_2CH(OH)R^3$, and $R^3$ is as described above for Formula I; and $R^2$ in Formula V or VI, is as described above for Formula I, and x is at least 1. The compounds of Formulas II and Formula V may be derived from thiocatechol (a substituted thiocatechol in the case of Formula V), the compounds of formulas III and VI may be derived from 2-mercaptophenols and Formula IV from a 3-mercaptophenol.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon.

Examples of hydrocarbyl groups include:

(i) hydrocarbon substituents, that is, aliphatic (e.g., alkyl or alkenyl), alicyclic (e.g., cycloalkyl, cycloalkenyl) substituents, aryl, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups useful as hydrocarbyl groups may include at least 1, or at least 2, or at least 3, or at least 4 carbon atoms, and in some embodiments, up to 150, or up to 100, or up to 80, or up to 40, or up to 30, or up to 28, or up to 24, or up to 20 carbon atoms. Illustrative examples include methyl, ethyl, propyl, butyl, pentyl, hexyl, heptyl, octyl, 2-ethylhexyl, nonyl, decyl, undecyl, dodecyl, tridecyl, tetradecyl, hexadecyl, stearyl, icosyl, docosyl, tetracosyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, 4-methyl-2-pentyl, 2-propylheptyl, monomethyl branched-isostearyl, isomers thereof, mixtures thereof, and the like.

Representative alkenyl groups useful as hydrocarbyl groups include $C_2$-$C_{28}$ alkenyl groups, such as ethynyl, 2-propenyl, 1-methylene ethyl, 2-butenyl, 3-butenyl, pentenyl, hexenyl, heptenyl, octenyl, 2-ethylhexenyl, nonenyl, decenyl, undecenyl, dodecenyl, tridecenyl, tetradecenyl, hexadecenyl, isomers thereof, mixtures thereof, and the like.

Representative alicyclic groups useful as hydrocarbyl groups include cyclobutyl, cyclopentyl, and cyclohexyl groups.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl benzylphenyl, styrenated phenyl, p-cumylphenyl, α-naphthyl, β-naphthyl groups, and mixtures thereof.

Representative heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Hydrocarbylene groups are the divalent equivalents of hydrocarbyl groups, such as alkylene groups.

The salt of the compound of any one of Formulas I-VI may be formed by reacting a cation or source of the cation with the compound. The compound of Formula I-VI thus serves as the anion (or "substrate") in the salt. The cation or source thereof reacts with one or more of the residual OH groups to form a neutral or overbased salt of the above-described protected mercaptophenol.

In another embodiment, the protected mercaptophenol may be used to form a neutral salt. The exemplary salt may loosely be represented as Formula VII or Formula VIII:

Formula VII

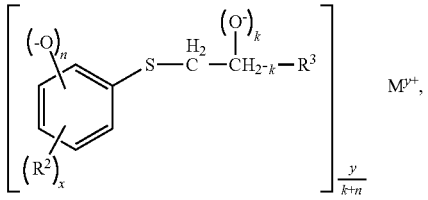

where $R^2$, $R^3$, n, and x are as described for Formula I,

M is the cation;

n is at least 1;

y is at least 1;

k is 0 or 1, and n+k is at least 1.

Formula VIII

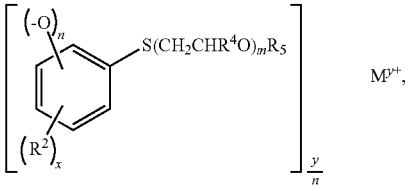

where n is at least 1.

In practice, the hydroxyl group of the hydroxy-substituted hydrocarbyl groups present may not be ionized, since it is not as acidic as the phenolic OH, leaving residual OH groups on the molecule when k is at least 1:

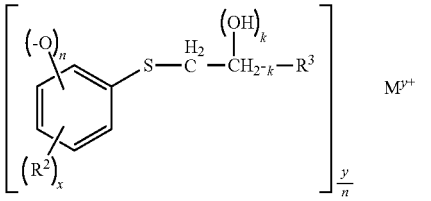

It is to be appreciated that the salt may include reaction products of the compound of Formula I with a source of the cation M that does not conform to these structures. For example, the cation may be present in non-stoichiometric amounts, for example, as a result of overbasing.

In one embodiment, the cation has an atomic weight of at least 6 or at least 10.

In one embodiment, the cation is a metallic cation. The metallic cation may be derived from an alkaline earth metal, such as calcium, barium or magnesium (typically calcium), or an alkali metal, such as sodium or potassium (typically sodium). Exemplary metal cations include alkali metal cations, alkaline earth metal cations, transition metal cations, and combinations thereof. Examples of metal cations include $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, $Sc^{3+}$, $Sc^{2+}$, $Sc^+$, $Y^{3+}$, $Y^{2+}$, $Y^+$, $Ti^{4+}$, $Ti^{3+}$, $Ti^{2+}$, $Zr^{4+}$, $Zr^{3+}$, $Zr^{2+}$, $Hf^{4+}$, $Hf^{3+}$, $V^{4+}$, $V^{3+}$, $V^{2+}$, $Nb^{4+}$, $Nb^{3+}$, $Nb^{2+}$, $Ta^{4+}$, $Ta^{3+}$, $Ta^{2+}$, $Cr^{4+}$, $Cr^{3+}$, $Cr^{2+}$, $Cr^+$, $Mo^{4+}$, $Mo^{3+}$, $Mo^{2+}$, $Mo^+$, $W^{4+}$, $W^{3+}$, $vv^{2+}$, $W^+$, $Mn^{4+}$, $Mn^{3+}$, $Mn^{2+}$, $Mn^+$, $Re^{4+}$, $Re^{3+}$, $Re^{2+}$, $Re^+$, $Fe^{6+}$, $Fe^{4+}$, $Fe^{3+}$, $Fe^{2+}$, $Fe^+$, $Ru^{4+}$, $Ru^{3+}$, $Ru^{2+}$, $Os^{4+}$, $Os^{3+}$, $Os^{2+}$, $Os^+$, $Co^{5+}$, $Co^{4+}$, $Co^{3+}$, $Co^{2+}$, $Co^+$, $Rh^{4+}$, $Ru^{3+}$, $Rh^{2+}$, $Rh^+$, $Ir^{4+}$, $Ir^{3+}$, $Ir^{2+}$, $Ir^+$, $Ni^{3+}$, $Ni^{2+}$, $Pd^{4+}$, $Pd^{2+}$, $Pd^+$, $Pt^{4+}$, $Pt^{3+}$, $Pt^{2+}$, $Pt^+$, $Cu^{4+}$, $Cu^{3+}$, $Cu^{2+}$, $Cu^+$, $Ag^{3+}$, $Ag^{2+}$, $Ag^+$, $Au^{4+}$, $Au^{3+}$, $Au^{2+}$, $Au^+$, $Zn^{2+}$, $Zn^+$, $Cd^{2+}$, $Cd^+$, $Hg^{4+}$, $Hg^{2+}$, $Hg^+$, $Al^{3+}$, $Al^{2+}$, $Al^+$, $Ga^{3+}$, $Ga^+$, $In^{3+}$, $In^{2+}$, $Tl^{3+}$, $Tl^+$, $Si^{4+}$, $Si^{3+}$, $Si^{2+}$, $Ge^{4+}$, $Ge^{3+}$, $Ge^{2+}$, $Ge^+$, $Sn^{4+}$, $Sn^{2+}$, $Pb^{4+}$, $Pb^{2+}$, $As^{3+}$, $As^{2+}$, $As^+$, $Sb^{3+}$, $Bi^{3+}$, $Te^{4+}$, $Te^{2+}$, $La^{3+}$, $La^{2+}$, $Ce^{3+}$, $Ce^{2+}$, $Pr^{4+}$, $Pr^{3+}$, $Pr^{2+}$, $Nd^{3+}$, $Nd^{2+}$, $Sm^{3+}$, $Sm^{2+}$, $Eu^{3+}$, $Eu^{2+}$, $Gd^{3+}$, $Gd^{2+}$, $Gd^+$, $Tb^{4+}$, $Tb^{3+}$, $Tb^{2+}$, $Tb^+$, $Db^{3+}$, $Db+^+$, $Ho^{3+}$, $Er^{3+}$, $Tm^{4+}$, $Tm^{3+}$, $Tm^{2+}$, $Yb^{3+}$, $Yb^{2+}$, and $Lu^{3+}$. Particularly useful are those which form stable salts, i.e., which do not decompose by more than a minor amount over the expected lifetime and operating conditions of the lubricating composition.

In one embodiment, the metallic cation is derived from a metal base such as a metal base of a hydroxide, an oxide, carbonate, or bicarbonate. The metal base may be a hydroxide or an oxide. For example, the metallic cation may be derived from calcium hydroxide, calcium oxide, sodium hydroxide, sodium oxide, magnesium hydroxide, magnesium oxide, or mixtures thereof.

In one embodiment, the cation is an ash-free cation. An ash-free (ashless) organic cation is an organic ion that does not contain ash-forming metals. In one embodiment, the compound in the salt form has a sulfated ash of up to 0.5 wt. %, or up to 0.4 wt. % according to ASTM D874.

In one embodiment, the cation is a pnictogen cation. As used herein, the term "pnictogens" includes the elements in column 15 of the periodic table. The non-metallic pnictogens include nitrogen and phosphorus (typically nitrogen). The pnictogen cation may be derived from a source of the cation containing a primary amine, a secondary amine, a tertiary amine, or mixtures thereof. In one embodiment, the amine salt may be derived from a secondary or tertiary amine.

When the cation is a pnictogen cation derived from an amine or ammonium compound, the pnictogen cation (or the amine from which it is derived) may have molecular weight of at least 260 g/mol, or at least 300 g/mol or at least 350 g/mol, or at least 500 g/mol.

The pnictogen cation may be derived from a mono-, di-, or tri-substituted amine. Specific examples include primary alkylamines, such as methylamine, ethylamine, n-propylamine, n-butylamine, n-hexylamine, n-octylamine, 2-ethylhexylamine, benzylamine, 2-phenylethylamine, cocoamine, oleylamine, and tridecylamine (CAS #86089-17-0); secondary and tertiary alkylamines such as isopropylamine, sec-butylamine, t-butylamine, cyclopentylamine, cyclohexylamine, and 1-phenylethylamine; dialkylamines, such as dimethylamine, diethylamine, dipropylamine, diisopropylamine, dibutylamine, dicyclohexylamine, di-(2-ethylhexyl)amine, dihexylamine, ethylbutylamine, N-ethylcyclohexylamine, and N-methylcyclohexylamine; cycloalkylamines, such as piperidine, N-ethylpiperidine, N,N"-dimethylpiperazine, morpholine, N-methylmorpholine, N-ethylmorpholine, N-methylpiperidine, pyrrolidine, N-methylpyrrolidine, and N-ethylpyrrolidine; and trialkylamines amines such as trimethylamine, triethylamine, tripropylamine, triisopropylamine, tri-n-butylamine, trihexylamine, N,N-dimethylbenzylamine, dimethylethylamine, dimethylisopropylamine, dimethylbutylamine, and N,N-dimethylcyclohexylamine.

When the pnictogen cation includes at least one hydrocarbyl group (a quaternary ammonium ion), the pnictogen cation may be an ashless organic cation. Example ammonium cations of this type include N-substituted long chain alkenyl succinimides and aliphatic polyamines. N-substituted long chain alkenyl succinimides useful herein may be derived from an aliphatic polyamine, or mixture thereof. The aliphatic polyamine may be aliphatic polyamine such as an ethylenepolyamine, a propylenepolyamine, a butylenepolyamine, or mixture thereof. Examples of N-substituted long chain alkenyl succinimides include polyisobutylene succinimide with number average molecular weight of the polyisobutylene substituent of at least 350, or at least 500, or at least 550, or at least 750, and can be up to 5000, or up to 3000, or up to 2500. Such succinimides can be formed, for example, from high vinylidene polyisobutylene and maleic anhydride.

Example N-substituted long chain alkenyl succinimides useful herein as pnictogen cations include those derived from succinimide dispersants, which are more fully described in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

Example aliphatic polyamines useful as the pnictogen cation include ethylenepolyamines, propylenepolyamines, butylenepolyamines, and mixtures thereof. Example ethylenepolyamines include ethylenediamine, diethylenetriamine, triethylenetetramine, tetraethylenepentamine, pentaethylenehexamine, polyamine still bottoms, and mixtures thereof.

In one embodiment, the protected mercaptophenol salt may be overbased, i.e., contain an excess of the metal cation in relation to the number of hydroxyl groups present in the compound.

Total base number (TBN), as used herein, is the quantity of acid, expressed in terms of the equivalent number of milligrams of potassium hydroxide (meq KOH), that is required to neutralize all basic constituents present in 1 gram of a sample of the lubricating oil. The TBN values reported herein are determined according to ASTM Standard D2896-11, "Standard Test Method for Base Number of Petroleum Products by Potentiometric Perchloric Acid Titration" (2011), ASTM International, West Conshohocken, Pa., 2003 DOI: 10.1520/D2896-11 (hereinafter, "D2896"). In various aspects, the neutral salt compound has a TBN of at least 25 mg of KOH/g, or at least 40 mg of KOH/g on an oil-free basis. The TBN of the neutral salt may be up to 250, or up to 165 mg KOH/g, on an oil-free basis. In various aspects, the lubricating composition containing the compound has a TBN of at least 5 or at least 6 mg of KOH/g.

Base number (BN) is another method for measuring the base number and is measured according to ASTM D4739-11, Standard Test Method for Base Number Determination by Potentiometric Hydrochloric Acid Titration, ASTM International, West Conshohocken, Pa., 2011, DOI: 10.1520/D4739-11. In various aspects, the lubricating composition has a BN of at least 3.4 mg of KOH/g, or at least 5 mg of KOH/g.

The cation may serve as a basic component of the lubricating composition which, in combination with any other basic components of the lubricating composition, may provide the lubricating composition with a TBN of at least 5, or at least 8, or at least 10, or at least 15, or at least 25. The cation itself may have a TBN of at least 8, or at least 10, or at least 15, or at least 25, or at least 50.

The exemplary protected mercaptophenol compound may have an average molecular weight of at least 223, or at least 239, or at least 253, or at least 267 in its unsalted form, i.e., prior to neutralization. The weight average molecular weight of the compound may be up to 750 or up to 500 in its unsalted form.

B. Method of Forming the Compound

A protected mercaptophenol compound of Formula I may be formed by (i) reacting a mercaptophenol with an oxirane (e.g., epoxide), ether, or a poly(ether), optionally in the presence of a catalyst, to form a sulfur-substituted intermediate compound, and, optionally (ii) reacting the sulfur-substituted intermediate compound with a metal base or pnictogen base to form a salt.

For example, in the case of a mercaptophenol reacting with a 1,2 epoxide, the reaction scheme may be as shown in reaction Scheme 1:

Scheme 1

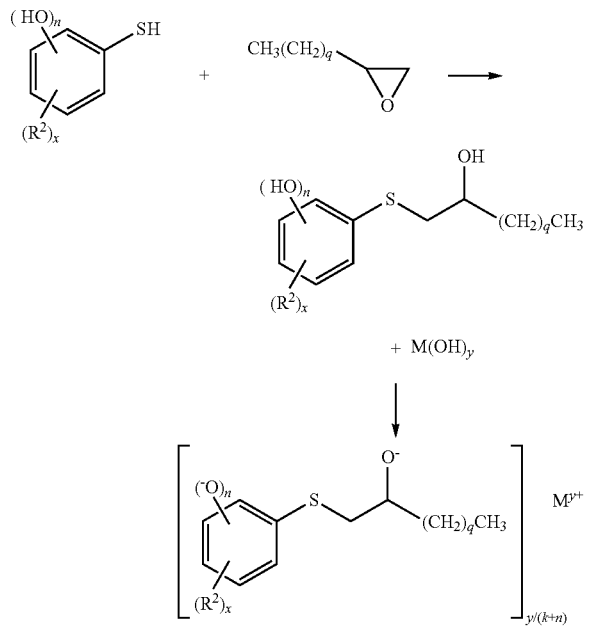

where q is, for example, at least 5, such as at least 7 or at least 9, or at least 10, or at least 11, x may be 0, 1, or more, and $M^{v+}$ represents a cation. As an example, the mercaptophenol may be an unsubstituted thiocatechol (x=0) or a substituted thiocatechol (x>0).

(i) Formation of the Intermediate

The reaction with the oxirane may be carried out at room temperature (20-30° C.) or in some cases, at below room temperature, such as 5-15° C. In some cases, e.g., when thiocatechol or substituted thiocatechol is used, a catalyst may be employed, such as a metal trifluoromethanesulfonate (triflate). Example metal triflates include indium triflate, bismuth triflate, copper triflate, cobalt triflate, chromium triflate, iron triflate, cadmium triflate, nickel triflate, manganese triflate, tin triflate, titanium triflate, vanadium triflate, yttrium triflate, zinc triflate, gadolinium triflate, lanthanum triflate, aluminum triflate, cerium triflate, praseodymium triflate, neodymium triflate, samarium triflate, europium triflate, terbium triflate, dysprosium triflate, holmium triflate, erbium triflate, thulium triflate, ytterbium triflate, or lutetium triflate, and mixtures thereof.

The oxirane employed may be a 2-alkyloxirane having at least 8 or at least 12 carbon atoms and in some embodiments, up to 24 or up to 20, or up to 18 carbon atoms. Examples of 2-alkyloxiranes include 2-octyloxirane, 2-nonyloxirane, 2-decyloxirane, 2-undecyloxirane, 2-dodecyloxirane, 2-tridecyloxirane, 2-tetradecyloxirane, 2-pentadecyloxirane, 2-hexadecyloxirane, 2-heptadecyloxirane, 2-octadecyloxirane, 2-nonadecyloxirane, 2-eicosyloxirane, and mixtures thereof.

The formation of the intermediate may be performed in the presence or absence of solvent. The solvent may include a hydrocarbon such as hexane, toluene, xylene, diluent oil, cyclohexane, or mixture thereof.

The intermediate may be formed in neat conditions. Neat solutions are such that compounds are reacted without a solvent, allowing for mixing at ambient temperatures, pressure and atmosphere to provide almost quantitative conversions.

The reaction pressure will generally be atmospheric, although higher or lower pressures may be employed. The process of forming the intermediate can be practiced in a batch-wise, continuous or semi-continuous manner.

ii) Formation of the Salt

Formation of the salt may be performed by reaction of the protected mercaptophenol intermediate with a base which serves as a cation source, such as lime (calcium hydroxide/oxide) or magnesium oxide, or with a pnictogen base, in approximately equimolar amounts, with respect to the residual OH groups in the intermediate compound, optionally in the presence of a solvent. The reaction may be carried out at elevated temperatures, e.g., 50-80° C., optionally in an inert atmosphere, such as nitrogen. Following the reaction, the solvent can be removed under vacuum and the resulting mixture filtered.

Suitable metal basic compounds include hydroxides, oxides and alkoxides of a metal such as (1) an alkali metal salt derived from a metal base selected from an alkali hydroxide, alkali oxide or an alkali alkoxide, or (2) an alkaline earth metal salt derived from a metal base selected from an alkaline earth hydroxide, alkaline earth oxide or alkaline earth alkoxide. Representative examples of metal basic compounds with hydroxide functionality include lithium hydroxide, potassium hydroxide, sodium hydroxide, magnesium hydroxide, calcium hydroxide, barium hydroxide, aluminum hydroxide and the like. Representative examples of metal basic compounds with oxide functionality include lithium oxide, magnesium oxide, calcium oxide, barium oxide and the like. In one embodiment, the alkaline earth metal base is slaked lime (calcium hydroxide). Pnictogen bases suitable for use herein may be derived from a primary amine, a secondary amine, or a tertiary amine compound, or mixture thereof. Typically the amine salt may be derived from a secondary or a tertiary amine.

The amine that can be used to prepare a pnictogen base can be any amine capable of salting with a protic acid.

The amine may be an alkyl amine, typically a di- or tri-alkyl amine. The alkyl amine may have alkyl groups having 1 to 30, or 2 to 20, or 3 to 10 carbon atoms. Examples of a dialkyl amine include diethylamine, dipropylamine, dibutylamine, dipentylamine, dihexylamine, di-(2-ethylhexyl)amine, di-decylamine, di-dodecylamine, di-stearylamine, di-oleylamine, di-eicosylamine, or mixtures thereof. Examples of a trialkyl amine include triethylamine, tripropylamine, tributylamine, tripentylamine, trihexylamine, tri-(2-ethylhexyl)amine, tri-decylamine, tridodecylamine, tri-stearylamine, tri-oleylamine, tri-eicosylamine, or mixtures thereof.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

In one embodiment the pnictogen base includes a phosphorus acid amine salt which includes an amine with $C_{11}$ to $C_{22}$ tertiary alkyl primary groups or mixtures thereof.

In one embodiment the amine salt may be in the form of a quaternary ammonium salt. Examples of quaternary ammonium salts containing a hydroxyalkyl group, and methods for their synthesis, are disclosed in U.S. Pat. No. 3,962,104. In certain embodiments, the quaternary ammonium compound is derived from a monoamine by means of alkylation, i.e., from a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. The tetraalkylammonium hydroxide may contain alkyl groups having 1 to 30, or 2 to 20, or 3 to 10 carbon atoms. The tetraalkylammonium hydroxide may include tetrapropylammonium hydroxide, tetrabutylammonium hydroxide, tetrapentylammonium hydroxide, tetrahexylammonium hydroxide, tetra-2-ethylhexyl-ammonium hydroxide, tetradecylammonium hydroxide, or mixtures thereof.

The amine may be quaternized with a quaternizing agent, or mixture thereof.

The pnictogen base may further include aminoalkyl substituted heterocyclic compounds such as 1-(3-aminopropyl) imidazole and 4-(3-aminopropyl)morpholine, 1-(2-aminoethyl)piperidine, 3,3'-diamino-N-methyldipropylamine, and 3,3-aminobis(N,N-dimethylpropylamine).

Other examples of quaternary ammonium salts and methods for preparing the same are described in U.S. Pat. Nos. 3,778,371, 4,171,959, 4,253,980, 4,326,973, 4,338,206, and 5,254,138.

When the amine salt is derived from an aromatic amine, the aromatic amine may form an ion such as a pyridinium ion, or an imidazolium ion. Certain quaternary phosphonium salts may be prepared by the reaction of phosphine with aldehydes and a halide e.g., tetrakis(hydroxymethyl)phosphonium halide (typically chloride).

A quaternary pnictogen halide compound may be a commercially available material, or it may be prepared by reaction of a tertiary amine with a hydrocarbyl halide, by known techniques. This reaction may be performed in a separate vessel or in the same vessel in which it is subsequently (or simultaneously) reacted with the oil-soluble acidic compound, which may be converted previously (or simultaneously) into its metal neutralized form.

Neutralization of the intermediate compound may be carried out in a continuous or batch process by any method known to a person skilled in the art. In general, neutralization can be carried out by contacting the intermediate compound with a metal or pnictogen base under reactive conditions, e.g., in an inert-compatible liquid hydrocarbon diluent. If desired, the reaction can be conducted under an inert gas, such as nitrogen. The metal or pnictogen base may be added either in a single addition or in a plurality of additions at intermediate points during the reaction.

The neutralization may be conducted in a suitable solvent or diluent oil, such as toluene, xylene and commonly with a promoter such as an alcohol, e.g., a $C_1$ to $C_{16}$ alcohol, such as methanol, decyl alcohol, or 2-ethylhexanol; a diol, e.g., $C_2$ to $C_4$ alkylene glycols, such as ethylene glycol; and/or carboxylic acids. Suitable diluent oils include naphthenic oils and mixed oils, e.g., paraffinic. The quantity of solvent or diluent oil used may be such that the amount of solvent or oil in the final product constitutes from 15% to 65% by weight of the final product, such as from about 25% to 50%.

The neutralization reaction may be conducted at temperatures above room temperature (20° C.). In general, neutralization can be carried out at a temperature of 60-150° C. The neutralization reaction itself may take place over a period of from 5 minutes to 1-3 hours.

In one embodiment, the exemplary protected mercaptophenol salt may be overbased. Overbasing can be carried out either during or after the neutralization step. In general, the overbasing is carried out by reaction of the salt with an acidic overbasing compound, such as carbon dioxide or boric acid. In one embodiment, an overbasing process is by way of carbonation, i.e., a reaction with carbon dioxide. Such carbonation can be conveniently effected by addition of solvents such as aromatic solvents, alcohols or a polyols, typically an alkylene diol, e.g., ethylene glycol. Conveniently, the reaction is conducted by the simple expedient bubbling of gaseous carbon dioxide through the reaction mixture, optionally in the presence of sulfonic acid. Excess solvents and any water formed during the overbasing reaction can be conveniently removed by distillation either during or after the reaction.

In one embodiment, the overbasing reaction is carried out in a reactor by reacting the salt of the protected mercaptophenol with a source of an alkaline earth metal such as lime (i.e., an alkaline earth metal hydroxide) in the presence of carbon dioxide, and in the presence of an aromatic solvent (e.g., xylene), and a hydrocarbyl alcohol such as methanol. The carbon dioxide is introduced over a period of 1 hour to 3 hours, at a temperature ranging from 40° C.-200° C., or from 40° C.-70° C., or from 150° C.-200° C. The degree of overbasing may be controlled by the quantity of the source of an alkaline earth metal, carbon dioxide and the reactants added to the reaction mixture and the reaction conditions used during the carbonation process.

In another embodiment, the overbasing reaction can be carried out at from 140° C.-180° C. in the presence of a polyol, typically an alkylene diol, e.g., ethylene glycol, and/or alkanols, e.g., $C_6$ to $C_{16}$ alkanol(s), such as decyl alcohols or 2-ethyl hexanol. Excess solvent and any water formed during the overbasing reaction can be conveniently removed by distillation either during or after the reaction.

Methods for forming overbased detergents useful herein are described, for example, in U.S. Pat. Nos. 5,259,966, 6,015,778, 5,534,168, and 6,268,318, and U.S. Pub. No. 2013/0203639.

In one embodiment, the optionally-overbased salt does not contain any sulfonate functional groups. In one embodiment, the optionally-overbased salt does not contain any phosphate functional groups. In one embodiment, the optionally-overbased salt does not contain any borate functional groups. In another embodiment, the optionally-overbased salt does contain a borate functional group.

The salts described above can be boronated by processes know to those skilled in the art. Boration can be accomplished either prior to, or after, the overbasing step. The boration can be accomplished by a number of boronating agents, such as boric acid, metaboric acid, orthoboric acid, alkyl borates, boron halides, polymers of boron, esters of boron and similar materials. When present, the boron content of the salt may be 0.1 wt. % to 5 wt. %, or 1 wt. % to 5 wt. %, or 2 wt. % to 4 wt. %.

The exemplary protected mercaptophenol salt may be formed from an anion composed of carbon, hydrogen, oxygen, boron and nitrogen; and a metallic cation.

In one embodiment, the salt of the protected mercaptophenol may comprise or consist of an anion comprising or consisting of carbon, hydrogen, and oxygen; and a metallic cation, such as a calcium, magnesium, or sodium cation.

C. Lubricating Composition

The protected mercaptophenol or salt thereof may be present in the lubricating composition at a concentration of at least 0.01 wt. % and may be up to 20 wt. %. For example, the concentration of the exemplary compound of Formula I may be at least 0.1 wt. %, or at least 0.2 wt. %, or at least 0.3 wt. %, or at least 0.4 wt. %, or at least 0.5 wt. %, or at least 1 wt. %, or at least 2 wt. % of the lubricating composition. The concentration of the compound may be up to 10 wt. %, or up to 5 wt. %, or up to 3 wt. %, or up to 2.5 wt. %. The compound may also be present in a concentrate, alone or with other additives and with a lesser amount of oil. In a concentrate, the amount of the compound may be at least 2, or at least 3 times the concentration in the lubricating composition.

In addition to the protected mercaptophenol or salt thereof, the exemplary lubricating composition includes an oil of lubricating viscosity and optionally one or more additional performance additives suited to providing the performance properties of a fully formulated lubricating composition, e.g., a marine diesel cylinder lubricant.

The amount of the oil of lubricating viscosity present may be typically the balance remaining after subtracting from 100 wt. %, the sum of the amount of the compound as described herein, and any other performance additives. The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. % of the lubricating composition.

Examples of these additional performance additives include (overbased) detergents, viscosity modifiers, friction modifiers, antioxidants, dispersants, antiwear/antiscuffing agents, metal deactivators, extreme pressure agents, foam inhibitors, demulsifiers, pour point depressants, corrosion inhibitors, seal swelling agents, and the like, which may be used singly or in combination.

The lubricating composition comprising may have a kinematic viscosity of 2 cSt to 20 cSt at 100° C., as measured by ASTM D445-14. The lubricating composition is liquid, i.e., not a gel or semi-solid, at ambient temperatures (5-30° C.).

In one embodiment the lubricating composition is not an aqueous composition.

D. Oil of Lubricating Viscosity

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/147704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. % saturates, viscosity index 80-120); Group II (sulfur content ≤0.03 wt. %, and ≥90 wt. % saturates, viscosity index 80-120); Group III (sulfur content ≤0.03 wt. %, and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The lubricating composition disclosed herein may have a SAE viscosity grade of XW-Y, wherein X may be 0, 5, 10 or 15; and Y may be 16, 20, 30 or 40. Examples include 0W-16, 0W-20, 5W-16, 5W-20, 10W-30, and 10W-40.

The oil of lubricating viscosity may have a kinematic viscosity of up to 30 $mm^2/s$ or up to 25 $mm^2/s$ (cSt) at 100° C. and can be at least 12 $mm^2/s$ at 100° C., and in other embodiments at least 15 $mm^2/s$. As used herein, kinematic viscosity is determined at 100° C. by ASTM D445-14, "Standard Test Method for Kinematic Viscosity of Transparent and Opaque Liquids (and Calculation of Dynamic Viscosity)," ASTM International, West Conshohocken, Pa., 2003, DOI: 10.1520/D0445-14 and may be referred to as KV_100.

The viscosity grade of cylinder oils suited to use in 2-stroke marine diesel engines may be from SAE-40 to SAE-60, which corresponds to a KV_100 of 12.5 to 26 $mm^2/s$. SAE-50 grade oils, for example, have a KV_100 of 16.3-21.9 $mm^2/s$. Cylinder oils for 2-stroke marine diesel engines may be formulated to achieve a KV_100 of 19 to 21.5 $mm^2/s$. This viscosity can be obtained by a mixture of additives and base oils, for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

As an example, an oil formulation suited to use as a cylinder lubricant for low-speed 2-stroke marine diesel engines contains 18 to 25 wt. % of a Group I base oil of a BSS type (distillation residue, with a KV_100 of 28-32 $mm^2/s$, with a density at 15° C. of 895-915 $kg/m^3$), and 50 to 60 wt. % of a Group I base oil of a SN 600 type (distillate, with a density at 15° C. of 880-900 $kg/m^3$, with a KV_100 of 12 $mm^2/s$).

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, poly-acrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Synthetic ester base oils may be present in the lubricating composition of the invention in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition of the invention is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rapeseed oil, and soya oil.

The amount of the oil of lubricating viscosity present is typically the balance remaining after subtracting from 100 weight % the sum of the amount of the exemplary protected mercaptophenol compound and the other performance additives.

E. Method of Forming the Lubricating Composition

A lubricating composition may be prepared by combining the protected mercaptophenol or salt thereof with an oil of lubricating viscosity, optionally in the presence of other performance additives (as described herein below), or by adding reagents for forming the protected mercaptophenol compound to an oil of lubricating viscosity.

F. Other Performance Additives

In addition to the exemplary protected mercaptophenol compound(s) disclosed herein, the lubricating composition may further include one or more of the following additional performance additives: detergents, antioxidants, dispersants, viscosity modifiers, antiwear/antiscuffing agents, metal deactivators, friction modifiers, extreme pressure agents, foam inhibitors, demulsifiers, pour point depressants, corrosion inhibitors, seal swelling agents, and the like.

1. Detergents

The lubricating composition optionally further includes at least one detergent which is different from that of the exemplary protected mercaptophenol. Exemplary detergents useful herein include overbased metal-containing detergents. The metal of the metal-containing detergent may be zinc, sodium, calcium, barium, or magnesium. The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Alkylphenols may be used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be a linear or branched aliphatic group of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e., contains less than 0.1 wt. %) p-dodecylphenol. In one embodiment, the lubricating composition contains less than 0.3 wt. % of alkylphenol, or less than 0.1 wt. % of alkylphenol, or less than 0.05 wt. % of alkylphenol.

Example overbased metal-containing detergents include zinc, sodium, calcium and magnesium salts of sulfonates, phenates (including sulfur-containing and non-sulfur containing phenates), salixarates and salicylates. Such overbased sulfonates, salixarates, phenates and salicylates may have a total base number of 120 to 700, or 250 to 600, or 300 to 500 (on an oil free basis).

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

In one embodiment, the lubricating composition may be free of linear alkylbenzene sulfonate detergent. The sulfonate detergent may be a metal salt of one or more oil-soluble alkyl toluene sulfonate compounds as disclosed in U.S. Pub. No. 20080119378.

The lubricating composition may include at least 0.01 wt. % or at least 0.1 wt. %, detergent, and in some embodiments, up to 2 wt. %, or up to 1 wt. % detergent.

2. Antioxidants

The lubricating composition optionally further includes at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnapthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnapthylamines. Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

When present, the lubricating composition may include at least 0.1 wt. % or at least 0.5 wt. %, or at least 1 wt. % antioxidant, and in some embodiments, up to 3 wt. %, or up to 2.75 wt. %, or up to 2.5 wt. % antioxidant.

3. Dispersants

The lubricating composition optionally further includes at least one dispersant other than the exemplary compound. Exemplary dispersants include succinimide dispersants, Mannich dispersants, succinamide dispersants, and polyolefin succinic acid esters, amides, and ester-amides, and mixtures thereof. The succinimide dispersant, where present, may be as described above for the succinimides described as useful for cation M.

The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment the dispersant may be a polyolefin succinic acid ester, amide, or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for example, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, and 7,238,650 and EP Patent Application 0 355 895 A.

The succinimide dispersant may comprise a polyisobutylene succinimide, wherein the polyisobutylene from which polyisobutylene succinimide is derived has a number average molecular weight of 350 to 5000, or 750 to 2500.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

When present, the lubricating composition may include at least 0.01 wt. %, or at least 0.1 wt. %, or at least 0.5 wt. %, or at least 1 wt. % dispersant, and in some embodiments, up to 20 wt. %, or up to 15 wt. %, or up to 10 wt. %, or up to 6 wt. % or up to 3 wt. % dispersant.

4. Anti-Wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

The lubricating composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof. In one embodiment, zinc dialkyldithiophosphate provides at least 50% of the total phosphorus present in the lubricating composition, or at least 70% of the total phosphorus, or at least 90% of the total phosphorus in the lubricating composition. In one embodiment, the lubricant composition is free or substantially free of zinc dialkyldithiophosphate(s) (i.e., contains less than 0.1 wt. % thereof).

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

5. Oil-Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2 ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent. The titanium-containing compound may be present in an amount to deliver at least 20 ppm titanium to the lubricating composition, or at least 40 ppm titanium, or at least 70 ppm titanium. The titanium-containing compound may be present in an amount to deliver 20 to 1000 ppm titanium to the lubricating composition, or 40 to 200 ppm titanium, or 70 to 150 ppm titanium.

6. Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyl disulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt. %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

7. Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

8. Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMAs are prepared from mixtures of methacrylate monomers having different alkyl groups. The alkyl groups may be either straight chain or branched chain groups containing from 1 to 18 carbon atoms. Most PMAs are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

9. Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

10. Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

11. Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

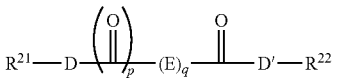

where, D and D' are independently selected from —O—, >NH, >$NR^{23}$, an imide group formed by taking together both D and D' groups and forming a $R^{21}$—N< group between two >C=O groups; E is selected from —$R^{24}$—O—$R^{25}$—, >$CH_2$, >$CHR^{26}$, >$CR^{26}R^{27}$, >C(OH)($CO_2R^{22}$), >C($CO_2R^{22}$)$_2$, and >$CHOR^{28}$; where $R^{24}$ and $R^{25}$ are independently selected from >$CH_2$, >$CHR^{26}$, >$CR^{26}R^{27}$, >C(OH)($CO_2R^{22}$), and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, citric acid, and mandelic acid. Examples of suitable materials include tartaric acid di(2-ethylhexyl) ester (i.e., di(2-ethylhexyl)tartrate), di($C_8$-$C_{10}$)tartrate, di($C_{12-15}$)tartrate, di-oleyl tartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 wt. % (or 0.12 to 1.2 or 0.15 to 0.8 wt. %). The material may also be present in a concentrate, alone or with other additives and with a lesser amount of oil. In a concentrate, the amount of material may be two to ten times the above concentration amounts.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{39}$ and $R^{31}$ is a hydrocarbyl group of 4 or more carbon atoms or represented by the formula:

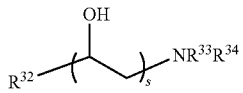

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, cocoyl methylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, bis(2-hexyldecyl)amine, bis(2-octyldodecyl)amine, bis(2-decyltetradecyl)amine, beef tallow dialkylamine, hardened beef tallow dialkylamine, and soybean oil dialkylamine; and trialk(en)ylamines such as tetradecyl dimethylamine, hexadecyl dimethylamine, octadecyl dimethylamine, beef tallow alkyldimethylamine, hardened beef tallow alkyldimethylamine, soybean oil alkyldimethylamine, dioleyl methylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal such as sodium or potassium, ammonium molybdates ($(NH_4)_2MoO_4$ or heptamolybdate $(NH_4)_6[Mo_7O_{24}].4H_2O$), $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other organomolybdenum compounds of the invention may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaminopropylamine, dodecylaminoethylamine, hexadecylaminopropylamine, hexadecylaminoethylamine, octadecylaminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube® 710 available from Adeka which is a molybdenum amine compound, and Molyvan® 855, available from R.T. Vanderbilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

12. Demulsifiers

Demulsifiers useful herein include trialkyl phosphates, and various polymers and copolymers of ethylene glycol, ethylene oxide, propylene oxide, and mixtures thereof.

13. Seal Swell Agents

Seal swell agents useful herein include sulfolene derivatives such as Exxon Necton-37™ (FN 1380) and Exxon Mineral Seal Oil™ (FN 3200).

G. Example Lubricating Compositions

An engine lubricant in different embodiments may have a composition as illustrated in Table 1. All additives are expressed on an oil-free basis.

TABLE 1

Example Lubricating Compositions

| | Embodiments (wt. %) | | |
|---|---|---|---|
| Additive | A | B | C |
| Example compound | 0.2 to 15 | 0.5 to 5 | 1 to 2.7 |
| Overbased Sulfonate Detergent | 0 to 9 | 0.3 to 8 | 1 to 5 |
| Phenol-based detergent | 0 to 10 | 0.1 to 3 | 0.5 to 1.5 |
| (Borated) Dispersant | 0 to 12 | 0.5 to 8 | 1 to 5 |
| Antioxidant | 0 to 13 | 0.3 to 10 | 1 to 5 |
| Antiwear Agent | 0 to 15 | 0.1 to 10 | 0.3 to 5 |
| Corrosion Inhibitor | 0 to 2 | 0.1 to 1 | 0.2 to 0.5 |
| Friction Modifier | 0 to 6 | 0.05 to 4 | 0.1 to 2 |
| Viscosity Modifier | 0 to 10 | 0.5 to 8 | 1 to 6 |
| Other Performance Additives | 0 to 10 | 0 to 8 | 0 to 6 |
| Oil of Lubricating Viscosity | | Balance to 100% | |

H. Use of the Lubricating Composition

The end use of the lubricating composition described herein includes use as a cylinder lubricant for an internal combustion engine, such as a 2-stroke marine diesel engine, but may also find use as an engine oil for passenger car, heavy, medium and light duty diesel vehicles, small engines such as motorcycle and 2-stroke oil engines, as a driveline lubricant, including gear and automatic transmission oils, and for other industrial oils, such as hydraulic lubricants.

An exemplary method of lubricating a mechanical device, such as a 2-stroke marine diesel engine cylinder, includes supplying the exemplary lubricating composition to the device.

Generally, the lubricating composition is added to the lubricating system of an internal combustion engine, which then delivers the lubricating composition to the cylinder of the engine, during its operation, where it may be combusted with the fuel.

The internal combustion engine may be a diesel-fueled engine, such as a 2-stroke marine diesel engine, or a gasoline fueled engine, a natural gas fueled engine, a mixed gasoline/alcohol fueled engine, or a biodiesel fueled engine. The internal combustion engine may be a 2-stroke or 4-stroke engine.

In one embodiment the disclosed technology provides a method of lubricating a 2-stroke or 4-stroke marine diesel internal combustion engine comprising supplying to the internal combustion engine a lubricating composition disclosed herein. The lubricating composition is typically used to lubricate the 2-stroke marine diesel cylinder liner.

The two-stroke marine diesel engine may be a 2-stroke, cross-head slow-speed compression-ignited engine usually has a speed of below 200 rpm, such as, for example, 10-200 rpm or 60-200 rpm.

The fuel of the 2-stroke marine diesel engine may contain a sulfur content of up to 5000 ppm, or up to 3000, or up to 1000 ppm of sulfur. For example the sulfur content may be 200 ppm to 5000 ppm, or 500 ppm to 4500 ppm, or 750 ppm to 2000 ppm.

The internal combustion engine may also be a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

The lubricating composition may be suitable for use as a cylinder lubricant irrespective of the sulfur, phosphorus or sulfated ash (ASTM D-874) content of the fuel. The sulfur content of the lubricating composition, which is particularly suited to use as an engine oil lubricant, may be 1 wt. % or less, or 0.8 wt. % or less, or 0.5 wt. % or less, or 0.3 wt. % or less. In one embodiment, the sulfur content may be in the range of 0.001 wt. % to 0.5 wt. %, or 0.01 wt. % to 0.3 wt. %. The phosphorus content may be 0.2 wt. % or less, or 0.12 wt. % or less, or 0.1 wt. % or less, or 0.085 wt. % or less, or 0.08 wt. % or less, or even 0.06 wt. % or less, 0.055 wt. % or less, or 0.05 wt. % or less. In one embodiment, the phosphorus content may be 100 ppm to 1000 ppm, or 200 ppm to 600 ppm. The total sulfated ash content may be 2 wt. % or less, or 1.5 wt. % or less, or 1.1 wt. % or less, or 1 wt. % or less, or 0.8 wt. % or less, or 0.5 wt. % or less, or 0.4 wt. % or less. In one embodiment, the sulfated ash content may be 0.05 wt. % to 0.9 wt. %, or 0.1 wt. % to 0.2 wt. % or to 0.45 wt. %.

Without intending to limit the scope of the exemplary embodiment, the following examples illustrate preparation and evaluation of example compounds.

EXAMPLES

All reactants and additives are expressed on an oil-free basis.

Example 1: Preparation of 1,2-Epoxytetradecane-Protected 2-Mercaptophenol 2-mercaptophenol and 1,2-epoxytetradecane (1:1 mol.) are added to a vial with a stir bar. The mixture is a pale yellow with a moderate odor. The mixture is stirred for 24 hours at ambient temperature. The product (1,2-epoxytetradecane-protected mercaptophenol) is slightly more viscous and darker yellow and is isolated without further purification (99.4% yield).

Example 2: Preparation of Calcium salt of 1,2-Epoxytetradecane-Protected 2-Mercaptophenol The 1,2-epoxytetradecane protected mercaptophenol of Example 1 (139 g, 0.37 mol., 1 eq.), diluent oil (97.2 g, 40% target) and 100 mL toluene are added to a 4 neck 1 L round bottom flask equipped with a stir bar, nitrogen inlet, and reflux condenser. Methanol (21.04 g) is added at 70° C. $Ca(OH)_2$ is then added portion wise (21.04 g, 0.56 mol., 1.5 eq.). The mixture is heated at 70° C. for 2 hours. After two hours of heating, the water and methanol are stripped off at 130° C. under vacuum for 30 minutes. The resulting mixture is filtered over a 30 g FAX-5 filter neat to yield a dark and clear mobile product (yield 79.8%).

Example 3: Preparation of 1,2-Epoxytetradecane-Protected 3-Mercaptophenol 3-mercaptophenol and 1,2-epoxytetradecane (1:1 mol.) are added to a vial with a stir bar and stirred for 24 hours at ambient temperature. The product (1,2-epoxytetradecane-protected 3-mercaptophenol) is isolated without further purification.

Example 4: Preparation of Calcium salt of 1,2-Epoxytetradecane-Protected 3-Mercaptophenol The 1,2-epoxytetradecane-protected 3-mercaptophenol of Example 3 (139 g, 0.37 mol., 1 eq.), diluent oil (97.2 g, 40% target) and 100 mL toluene are added to a 4 neck 1 L round bottom flask equipped with a stir bar, nitrogen inlet, and reflux condenser. Methanol (21.04 g) is added at 70° C. $Ca(OH)_2$ is then added portion wise (21.04 g, 0.56 mol., 1.5 eq.). The mixture is heated at 70° C. for two hours. After two hours of heating, the water and methanol are stripped out at 130° C. under vacuum for 30 minutes. The resulting mixture is filtered.

Example 5: Preparation of 1,2-Epoxytetradecane-Protected 4-Mercaptophenol 4-mercaptophenol and 1,2-epoxytetradecane (1:1 mol.) are added to a vial with a stir bar and stirred for 24 hours at ambient temperature. The product (1,2-epoxytetradecane-protected 4-mercaptophenol) is isolated without further purification. It is a pale yellow with a moderate odor.

Example 6: Preparation of Calcium salt of 1,2-Epoxytetradecane-Protected 4-Mercaptophenol The 1,2-epoxytetradecane-protected mercaptophenol of Example 5 (139 g, 0.37 mol., 1 eq.), dil. oil (97.2 g, 40% target) and 100 mL toluene are added to a 4 neck 1 L round bottom flask equipped with a stir bar, nitrogen inlet, and reflux condenser. Methanol (21.04 g) is added at 70° C. $Ca(OH)_2$ is then added portion wise (21.04 g, 0.56 mol., 1.5 eq.). The mixture is heated at 70° C. for two hours. After two hours of heating, the water and methanol are stripped off at 130° C. under vacuum for 30 minutes. The resulting mixture is filtered.

Example 7: Preparation of 1,2-Epoxytetradecane-Protected Thiocatechol

Thiocatechol (50 g, 0.45 mol., 1 eq.) is charged into a 250 mL round bottom flask equipped with a stir bar, thermocouple and addition funnel. The flask is placed in an ice bath and the temperature maintained at 10° C. Indium triflate (6.3 g, 0.011 mol., 0.025 eq.) is added to the thiocatechol, creating a white slurry. 1,2-epoxytetradecane (108.4 g, 0.45 mol., 1 eq.) is charged to the addition funnel and added slowly to the reaction mixture. The temperature does not exceed 30° C. The 1,2-epoxytetradecane is added to the mixture over 4 hours, resulting in a solid mass (1,2-epoxytetradecane-protected thiocatechol) carrying a strong thiocatechol odor. (81% yield).

Example 8: Preparation of Calcium salt of 1,2-Epoxytetradecane-Protected Thiocatechol To a 4 neck 1 L round bottom flask equipped with a stir bar, nitrogen inlet, and a reflux condenser, the 1,2-epoxytetradecane-protected thiocatechol of Example 8 (128.2 g, 0.349 mol., 1 eq.), diluent oil (90.18 g, 40% target), and 100 mL toluene are added. Methanol (20.23 g) addition and heating to 70° C. is employed to bring all materials in the mixture into solution. The resulting mixture is pale yellow and homogeneous. $Ca(OH)_2$ (20.23 g, 0.524 mol., 1.5 eq.) is added portion wise with no discernable exotherm. The reaction mixture turns colorless after the addition is complete. The reaction mixture is then heated an additional 2 h at 70° C. After 2 h at 70° C., the methanol and water are stripped out at 130° C. under a steady flow of nitrogen. The resulting mixture is then diluted with toluene for solvent filtration, centrifuged at 1800 rpm for 30 min, filtered through 30 g FAX-5 and concentrated under vacuum to yield a waxy pale low odor solid at ambient temperature (85%).

Reference Examples 9, 10, 11

As reference examples, baseline, no-phenate, and salicylate detergent compounds are used without the exemplary salts of the protected mercaptophenol.

Results

Blends are prepared by combining the detergent candidates with a lubricant formulation as shown in Table 2 at the same substrate to detergent ratio.

TABLE 2

| Lubricating Composition | EX A | EX B | EX C | EX D | EX E | EX F | EX G |
|---|---|---|---|---|---|---|---|
| Group III Base Oil | BALANCE TO 100% | | | | | | |
| Example 7 compound | | | | 2.21 | | | |
| Example 4 compound | | | | | 2.21 | | |
| Example 6 compound | | | | | | 2.21 | |
| Example 8 compound | | | | | | | 2.21 |
| Ca Phenate[1] | 1.4 | | | | | | |
| Ca Salicylate[2] | | | 3.31 | | | | |
| Dispersant[3] | 4.9 | 4.9 | 4.9 | 4.9 | 4.9 | 4.9 | 4.9 |
| Ashless Antioxidant[4] | 2.8 | 2.8 | 2.8 | 2.8 | 2.8 | 2.8 | 2.8 |
| Ca sulfonate | 0.06 | 0.06 | 0.06 | 0.06 | 0.06 | 0.06 | 0.06 |
| Secondary ZDDP | 0.44 | 0.44 | 0.44 | 0.44 | 0.44 | 0.44 | 0.44 |
| VI Improver[5] | 1.2 | 1.2 | 1.2 | 1.2 | 1.2 | 1.2 | 1.2 |
| Other Additives[6] | 0.76 | 0.76 | 0.76 | 0.76 | 0.76 | 0.76 | 0.76 |
| % Calcium | 0.128 | 0.015 | 0.209 | 0.087 | 0.071 | 0.034 | 0.017 |
| % Sulfur | 0.180 | 0.100 | 0.109 | 0.201 | 0.180 | 0.126 | 0.198 |

TABLE 2-continued

| Lubricating Composition | EX A | EX B | EX C | EX D | EX E | EX F | EX G |
|---|---|---|---|---|---|---|---|
| TBN (D2896) | 7.5 | 4.1 | 9.7 | 6.5 | 5.6 | 5.3 | 4.6 |
| TBN (D4739) | 3.59 | 1.08 | 6.25 | 2.84 | 2.59 | 1.61 | 0.86 |
| Sulfated ash (D874) | 0.51 | 0.2 | 0.8 | 0.42 | 0.34 | 0.26 | 0.21 |

[1]Overbased calcium salt of sulfur-coupled alkylphenol
[2]Overbased calcium salicylate detergent (44% oil; 170 TBN)
[3]Polyisobutylene succinimide dispersant made from high-vinylidene polyisobutylene (18 TBN)
[4]Combination of alkylated diphenylamine and hindered phenol ester antioxidants
[5]Styrene-butadiene block copolymer
[6]Other additives include pourpoint depressant, corrosion inhibitor, friction modifier, foam inhibitor, surfactants, and titanium additives Results of tests for oxidation, TBN and TBN retention, panel coker deposits, and Komatsu Hot Tube performance are shown in Table 3.

Oxidative stability is evaluated with the ACEA E5 oxidation bench test, CEC L-85-99. This is a pressure differential scanning calorimetry (PDSC) method which measures oxidation induction time (OIT). Results are reported as the time (in minutes) until the oil breaks and oxidation begins. Higher values are thus better.

TBN is evaluated in mg KOH/g. TBN retention performance is evaluated using a modified nitration/oxidation bench test. This test involves the addition of nitric acid and NOx to degrade a fully formulated lubricating oil and is modified to measure TBN at the start and end of test. A sample of 40 g of test oil is stressed with nitric acid and Fe(III) oxidation catalyst. The sample is then heated to 145° C. and bubbled with a mixture of air and NOx for 22 hours. TBN, as measured by ASTM D2896 and ASTM D4739, is measured at the start of test and at end of test (TBN Init. and TBN End). TBN retention is then measured as the difference.

The Komatsu hot tube test (280° C.) uses glass tubes which are inserted through, and heated by, an aluminum heater block. The test sample is pumped via a syringe pump through the glass tube for 16 hours, at a flow rate of 0.31 $cm^3$/hr, along with an air flow of 10 $cm^3$/min. At the end of the test, the tubes are rinsed and rated visually on a scale of 0 to 10, with 0 being a black tube and 10 being a clean tube.

Panel coker deposits are evaluated as follows: the sample, at 105° C., is splashed for 4 hours on an aluminum panel maintained at 325° C. The aluminum plates are analyzed using image analysis techniques to obtain a universal rating. The rating score is based on 100% being a clean plate and 0% being a plate wholly covered in deposit. Higher values are better, e.g., above 12% is acceptable.

TABLE 3

| 1,2-Epoxytetradecane-Protected Mercaptophenols | EX A | EX B | EX C | EX D | EX E | EX F | EX G |
|---|---|---|---|---|---|---|---|
| Oxidation PDSC L-85-99 Comparison | | | | | | | |
| OIT (minutes) | 207 | 175 | 221 | 197 | 188 | 110 | 228 |
| Komatsu Hot Tube | | | | | | | |
| Test Temp. (° C.) | 280 | 280 | 280 | 280 | 280 | 280 | 280 |
| Tube Rating Visual | 1 | 7 | 8 | 7.5 | 6.5 | 5.5 | 3 |
| Whole No. Rating | 1 | 7 | 8 | 7 | 6 | 5 | 3 |
| Panel Coker | | | | | | | |
| % Universal Rating | 92 | 50 | 49 | 76 | 70 | 64 | 65 |

The results in Table 3 suggest that 1,2-epoxytetradecane-protected mercaptophenol compounds may serve as viable alternatives to PDDP detergents.

Absence of a hydroxyl moiety and the presence of a protected sulfur linkage on the aromatic ring are sufficient to exceed the OIT demonstrated by the phenate baseline. All three candidates present promising OIT results by incorporating sulfur in a non-traditional manner and without coupling.

All 1,2-epoxytetradecane-protected detergent candidates perform better than the no phenate and salicylate baseline formulations in the Panel Coker evaluations. The best performer of the exemplary candidates in the Panel Coker evaluations is the 2-mercaptophenol variant at 76% (compared to the baseline 92%).

The results in Table 3 indicate there may be value in adding a sulfur component earlier on in the detergent synthesis process, which may eliminate or reduce the need for sulfur coupling and additional detergent modification.

As used herein, the term "comprising" is inclusive and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or steps not specified and "consisting essentially of" permits the inclusion of additional un-recited elements or steps that do not materially affect the basic and novel, and essential characteristics of the composition or method under consideration.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricating composition comprising:

at least 10 wt. % of an oil of lubricating viscosity comprising at least one of an API Group I, Group II, Group III, Group IV, and Group V base oil; and at least 0.01 wt. % of a compound comprising a protected mercaptophenol represented by the salt form of Formula I:

Formula I

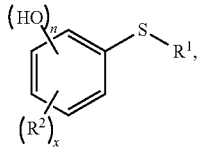

where $R^1$ is a poly(ether) group;

n is 1;

x is 0, and a cation selected from metal cations and pnictogen cations, the pnictogen cations being cations comprising elements in column 15 of the periodic table.

2. The lubricating composition of claim 1, wherein the compound has a weight average molecular weight of at least 223 in its unsalted form.

3. The lubricating composition of claim 1, wherein the compound is at least 0.1 wt. % to 20 wt. % of the lubricating composition.

4. The lubricating composition of claim 1, wherein the oil of lubricating viscosity is at least 20 wt. % to 95 wt. % of the lubricating composition.

5. The lubricating composition of claim 1, further comprising at least one of the group consisting of additional detergents, antioxidants, dispersants, antiwear agents, friction modifiers, and combinations thereof.

6. The lubricating composition of claim 1, wherein the lubricating composition has a SAE viscosity grade of XW-Y, wherein X is selected from 0, 5, 10 and 15; and Y is selected from 16, 20, 30, or 40.

7. A method of lubricating a mechanical device comprising supplying to the device a lubricating composition having at least 10 wt. % of an oil of lubricating viscosity comprising at least one of an API Group I, Group II, Group III, Group IV, and Group V base oil; and at least 0.01 wt. % of a compound comprising a protected mercaptophenol represented by the salt form of Formula I:

Formula I

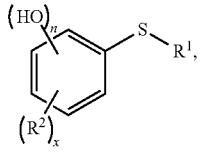

where $R^1$ is a poly(ether) group;

wherein the poly(ether) group is of the form $—(CH_2CHR^4—O)_mR^5$, wherein each $R^4$ is independently selected from H and an alkyl group which has no heteroatoms, and each $R^5$ is independently selected from hydrogen and an alkyl group which has no heteroatoms, and m is at least 1;

n is 1;

x is 0, and a cation selected from metal cations and pnictogen cations, the pnictogen cations being cations comprising elements in column 15 of the periodic table.

* * * * *